US008707883B2

(12) United States Patent
Peters

(10) Patent No.: US 8,707,883 B2
(45) Date of Patent: Apr. 29, 2014

(54) MODULAR FLOATING BAR WITH OPTIONAL CANOPY MOUNTS

(76) Inventor: Michael K. Peters, Cape Girardeau, MO (US)

( * ) Notice: Subject to any disclaimer, the term of this patent is extended or adjusted under 35 U.S.C. 154(b) by 341 days.

(21) Appl. No.: 13/228,359

(22) Filed: Sep. 8, 2011

(65) Prior Publication Data

US 2012/0060743 A1 Mar. 15, 2012

Related U.S. Application Data

(60) Provisional application No. 61/381,704, filed on Sep. 10, 2010.

(51) Int. Cl.
*B63B 35/73* (2006.01)

(52) U.S. Cl.
USPC ..... 114/266; 114/267

(58) Field of Classification Search
CPC ..... B63B 35/38; B63B 35/73; B63B 3/08
USPC ..... 114/263, 266, 267; 441/129, 35
See application file for complete search history.

(56) References Cited

U.S. PATENT DOCUMENTS 3,925,991 A * 12/1975 Poche ..... 405/65
4,887,716 A 12/1989 Abraham
5,197,404 A 3/1993 Haley et al.
5,213,447 A * 5/1993 Srock ..... 405/219
6,805,066 B2 * 10/2004 Johnson ..... 114/266

* cited by examiner

*Primary Examiner* — Edwin Swinehart
(74) *Attorney, Agent, or Firm* — Richard C. Litman

(57) ABSTRACT

The modular floating bar with optional canopy mounts is a floatation device with optional canopy mounts therefor. The device includes a plurality of modular segments that can be assembled and arranged in a various patterns to create a floating structure that is usable in pools, lakes and ponds or in any water that is relatively calm and devoid of strong current pulls. The modular segments are provided with a hinge and pin arrangement that permits easy assembly. The segments incorporate structure for retaining cups and beverage coolers therein. Support structure is also provided for mounting a canopy on the assembled segments.

4 Claims, 9 Drawing Sheets

MODULAR FLOATING BAR WITH OPTIONAL CANOPY MOUNTS

CROSS-REFERENCE TO RELATED APPLICATION

This application claims the benefit of U.S. Provisional Patent Application Ser. No. 61/381,704, filed Sep. 10, 2010.

BACKGROUND OF THE INVENTION

1. Field of the Invention

The present invention generally relates to recreational devices for the pool, lake, or the like, and particularly to a modular floating bar with optional canopy mounts that provides a floatation device that includes a bar area and an optional protective canopy.

2. Description of the Related Art

Leisurely enjoying the calm surface of a lake or pool while sipping a cool beverage to slake one's thirst and prevent dehydration is the epitome of total relaxation. This scenario is made even more enjoyable if the hot rays of the sun can some how be avoided. Unfortunately, because there is no suitable structure within the pool or lake to accomplish the above—recited functions, one must usually return to poolside or the beachfront to enjoy a beverage and/or escape the heat of the sun, thereby intruding on the relaxation mood. It would most certainly be convenient if cooled beverages could be stored on a floatation structure, which structure could also provide a shaded refuge, thereby permitting unbroken continuity of the relaxation mood. Thus, a modular floating bar with optional canopy mounts solving the aforementioned problems is desired.

SUMMARY OF THE INVENTION

The modular floating bar of the instant invention is a floatation device with optional canopy mounts therefor. The device comprises a plurality of modular segments that can be assembled and arranged in various patterns to create a floating structure that is usable in pools, lakes and ponds or in any water that is relatively calm and devoid of strong current pulls. The modular segments are provided with a hinge and pin arrangement that permits easy assembly. The segments incorporate means for retaining cups and beverage coolers therein. Support structure is also provided for mounting a canopy on the assembled segments.

Accordingly, the invention presents a recreational float that is easy to assemble and disassemble. Modular segment construction techniques allow the float to be assembled in a variety of configurations and sizes. Provision is made to mount a protective canopy on the float if desired. Provision is also made to retain beverage cups and beverage cooler receptacles on the float. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
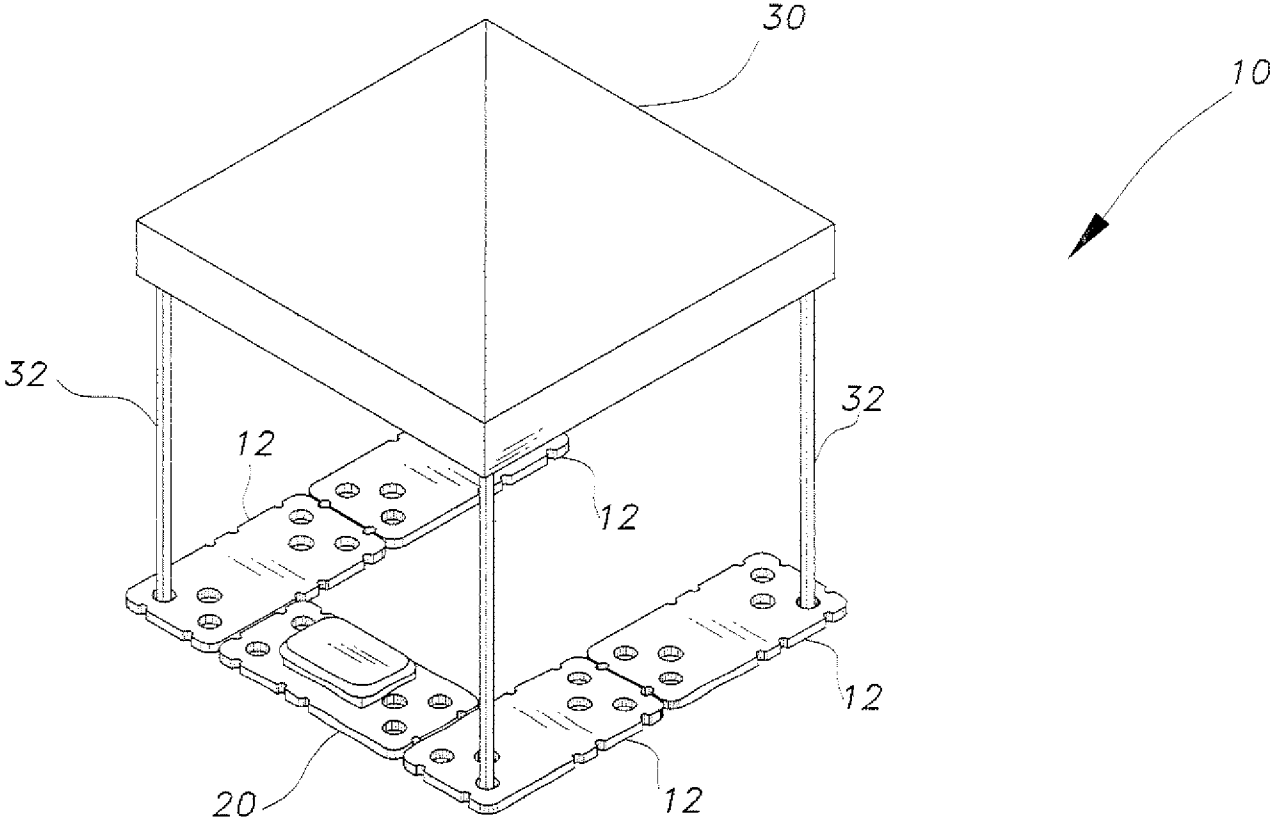
FIG. 1 is an environmental, perspective view of a first embodiment of an exemplary modular floating bar with optional canopy mounts according to the present invention.

Attention is first directed to FIGS. 1 through 4, wherein the first embodiment of the modular floating bar with optional canopy mounts is generally indicated at 10. The floating bar 10 comprises a plurality of modular segments 12 and 20 that are attached together to form an assembled float. Each of the modular segments 12, 20 is fabricated from a sturdy, lightweight, floatable material (preferably plastic—but not limited thereto). The float employs an assembly of straight segments 12, 20. A canopy 30 that is supported on removable poles 32 can be optionally mounted on the floating bar 10, when desired.

Figure 2:
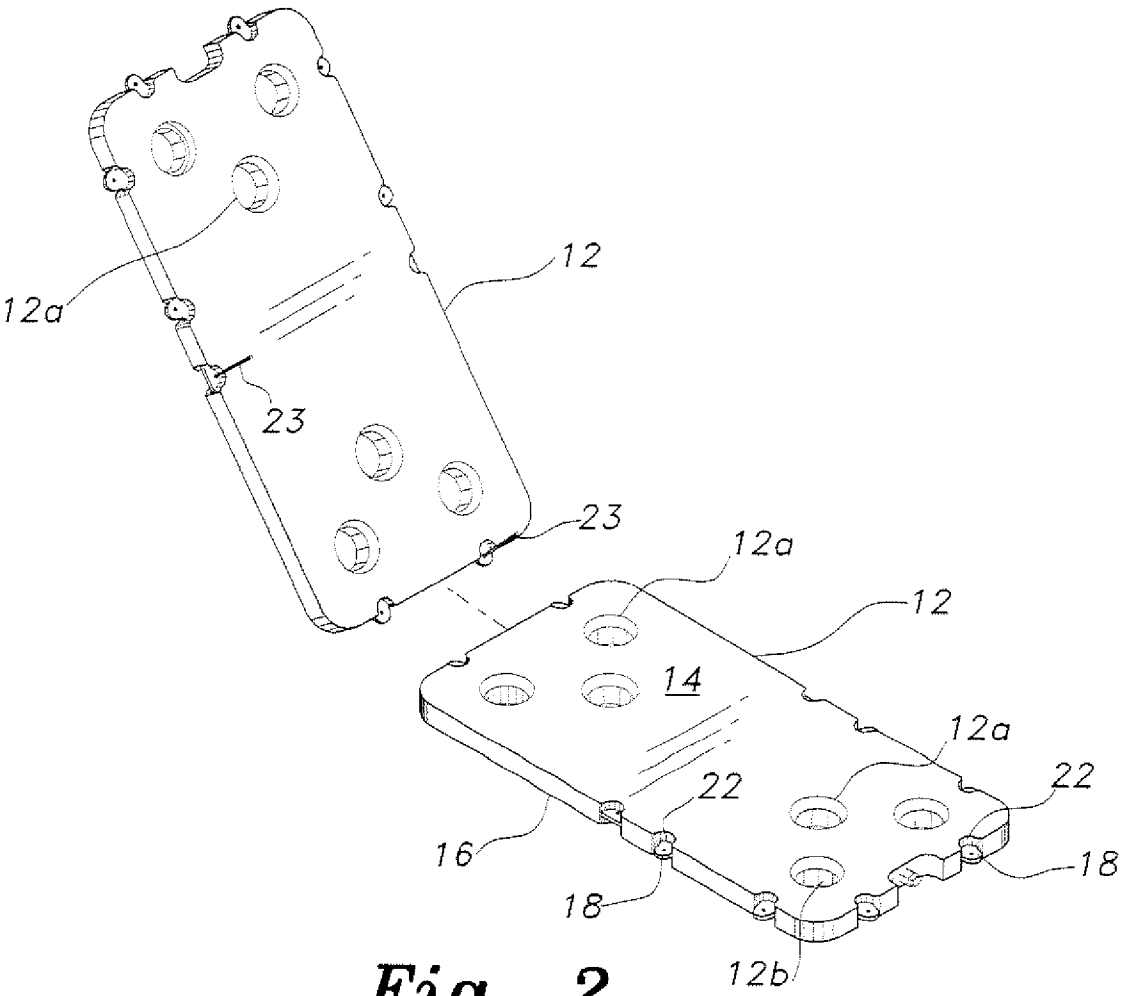
FIG. 2 is an exploded, perspective view of two segments of the first embodiment of the modular floating bar of FIG. 1.

As best seen in FIG. 2, each straight segment(s) 12 is preferably of a substantially rectangular configuration. It should be recognized, however, that other configurations may be utilized, if desired. Each segment 12 comprises an upper surface 14 and a bottom surface 16. Each upper surface 14 is provided with one or more receptacles or cavities 12*b* for retaining beverage cups therein. Additional cavities 12*a* are provided to support removable canopy poles 32 therein. Connecting structure comprising apertured protuberances 18 and recessed portions 22 are spaced along the sides and ends of each segment in an alternate pattern that permits a protuberance from one segment to reside in a recess of another segment when the segments are connected. Connector pins 23 are employed to fasten the segments together.

Figure 3:
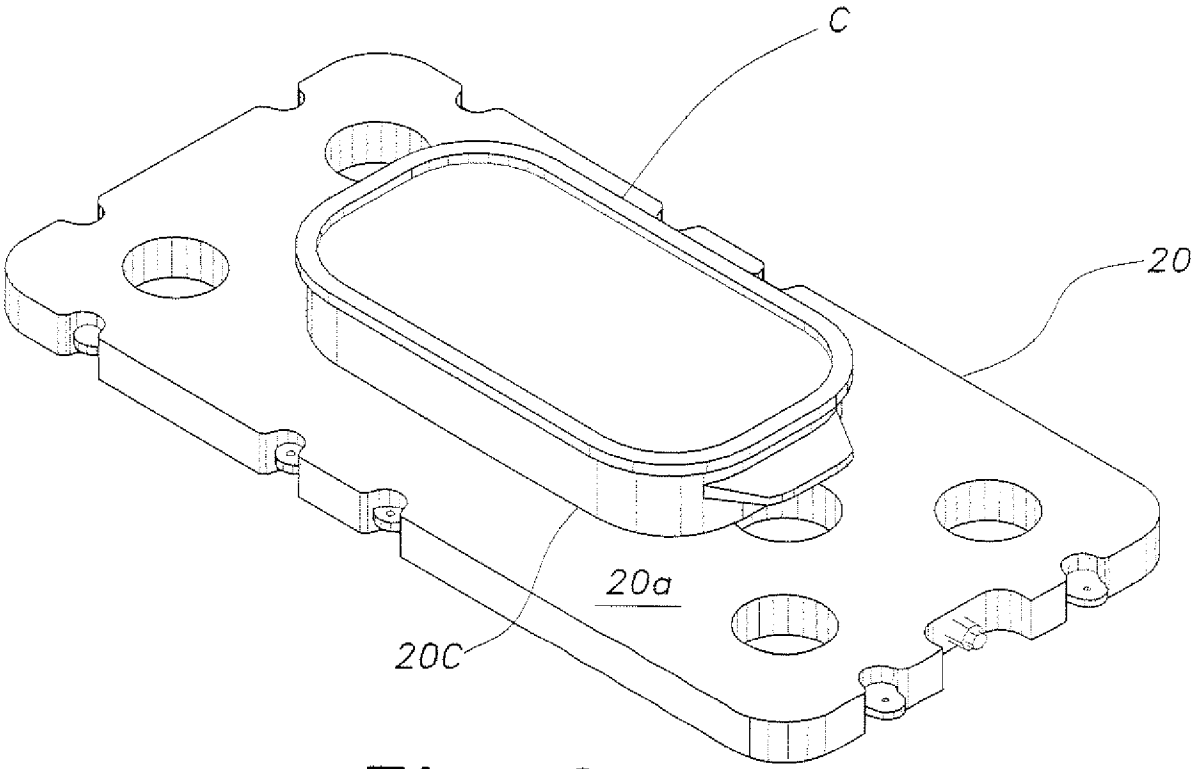
FIG. 3 is a perspective view of a cooler section of the modular floating bar of FIG. 1.
Figure 4:
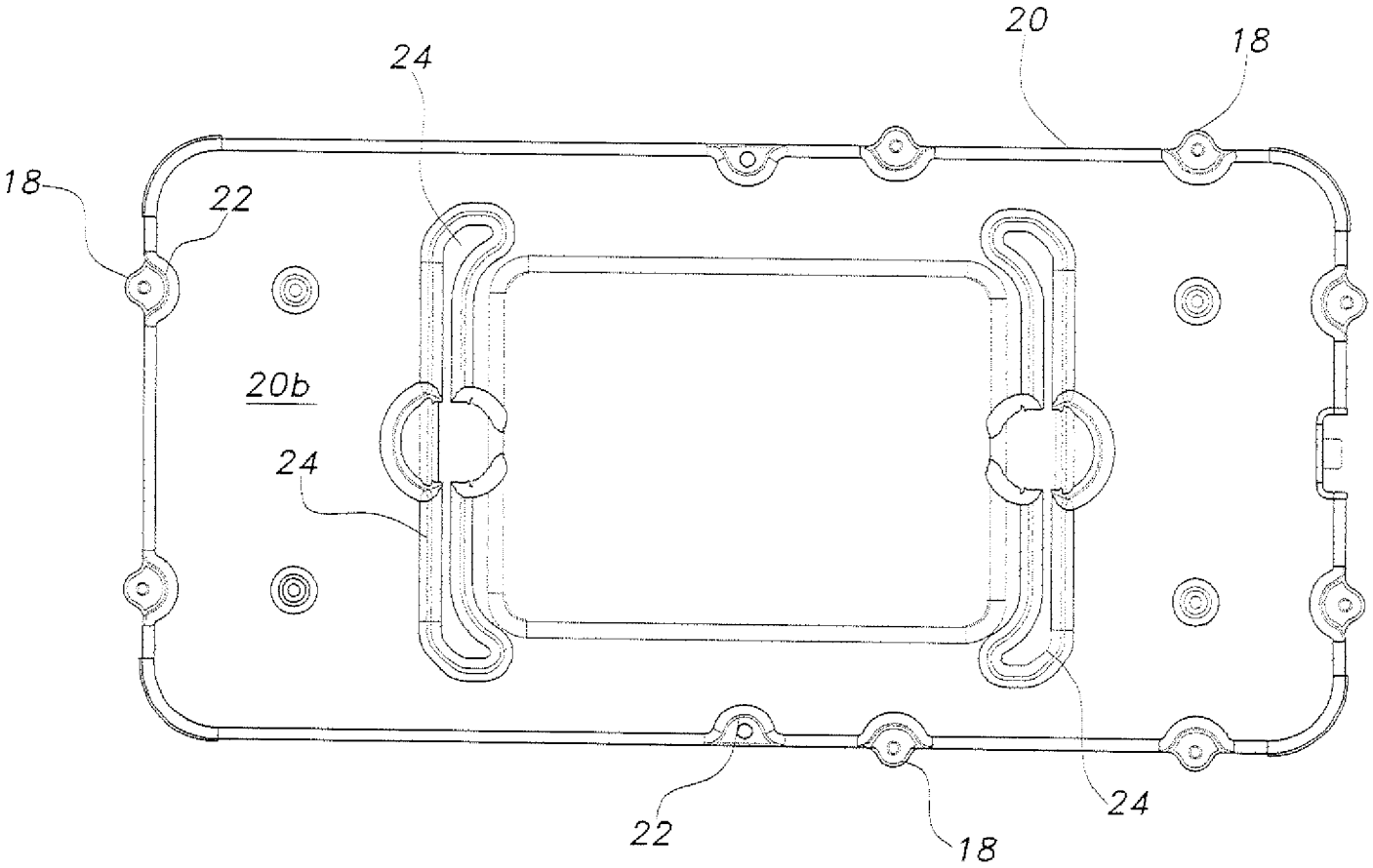
FIG. 4 is a bottom view showing leg-mounting grooves on a cooler section of the modular floating bar of FIG. 1.
Figure 5:
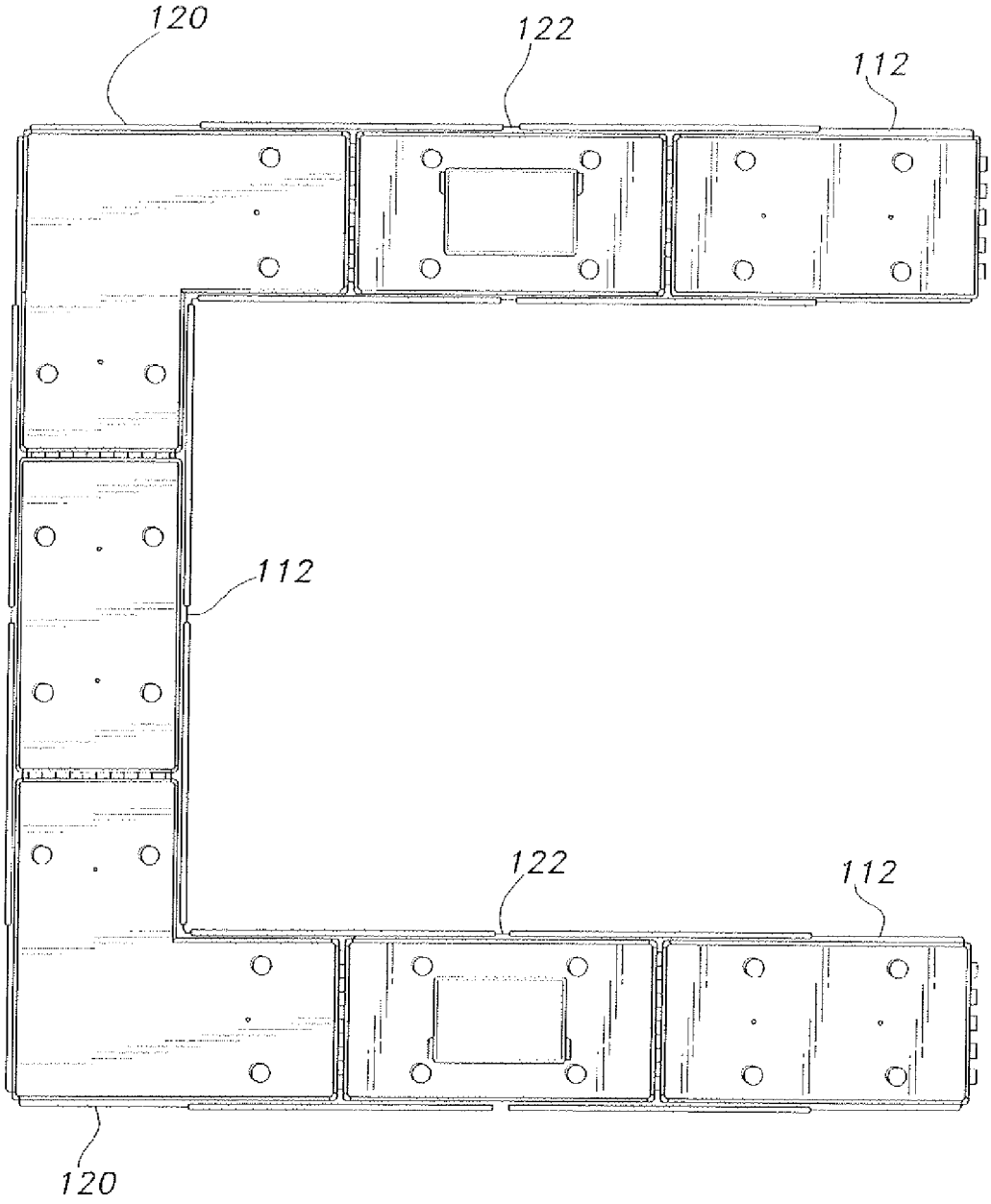
FIG. 5 is a top view of a second embodiment of the modular floating bar according to the present invention.

As best illustrated in FIG. 3, one or more specialized segments 20 having an upper surface 20*a* and a bottom surface 20*b* is fashioned with an opening 20*a* therethrough. Opening 20*a* is adapted to receive and stabilize a conventional cooler C therein. The cooler C extends through the opening and is chilled in the body of water.

On occasion it may be desired to use the segments as a platform or table. To accomplish this function, a groove 24 is provided on the bottom surface of the segments (FIG. 4) for accepting table leg structure (not shown) therein. Although the groove is shown on the bottom surface of a segment 20, it should be evident that a similar groove is also provided on the bottom surface of a segment 12 to accept table leg structure.

A second embodiment of the instant invention is illustrated in FIGS. 5-11. The floating bar of the second embodiment comprises a plurality of modular segments 112, 120, 122 that are attached together to form an assembled float. Each of the modular segments 112, 120, 122 is fabricated from a sturdy, lightweight, floatable material as indicated above. The float employs an assembly of straight segments 112, 122 and corner segments 120. As discussed above, a canopy 30 that is supported on removable poles 32 can be optionally mounted on the floating bar when desired.

Figure 6:
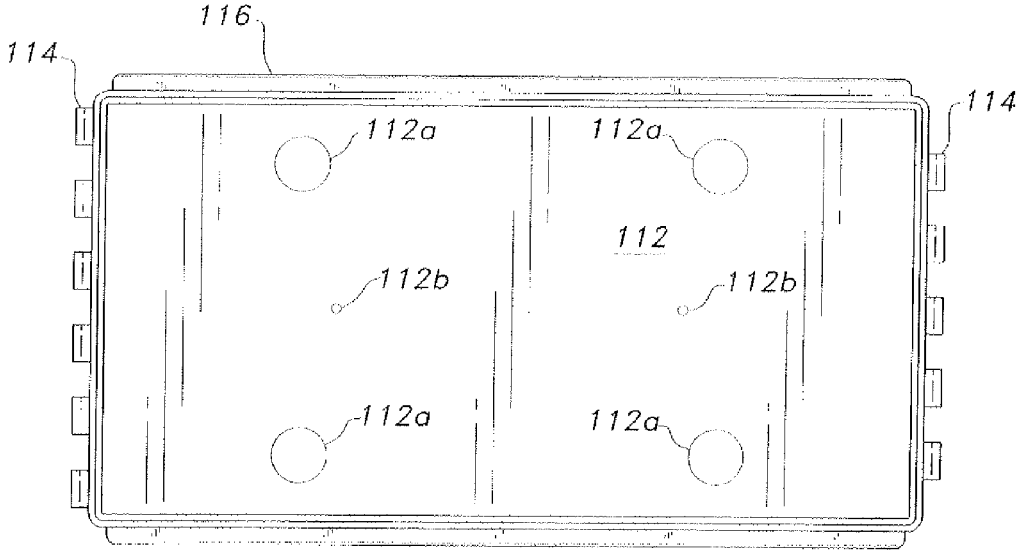
FIG. 6 is a top view of a straight modular segment of the modular floating bar of FIG. 5.
Figure 7:
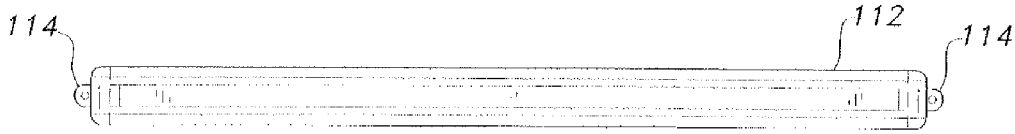
FIG. 7 is a side view of a straight modular segment of the modular floating bar of FIG. 5.
Figure 8:
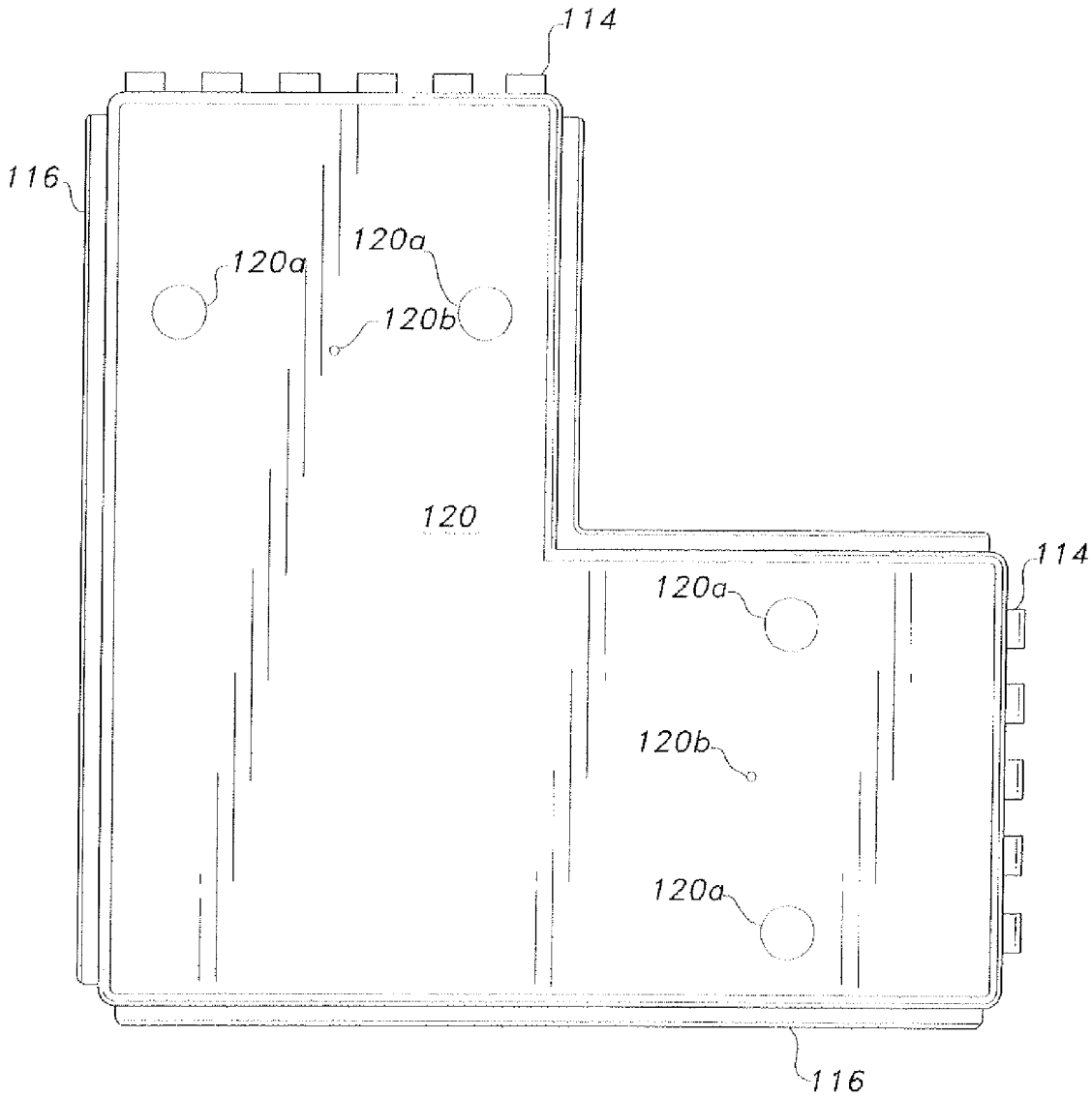
FIG. 8 is a top view of a corner modular segment of the modular floating bar of FIG. 5.

As best seen in FIGS. 6 and 7, the straight segment(s) 112 is preferably of substantially rectangular configuration. It should be recognized, however, that other configurations may be utilized, if desired. Each segment 112 comprises an upper surface that having one or more receptacles or cavities 112*a* for retaining beverage cups therein. Additional cavities 112*b* may be provided to support removable canopy poles 32 therein. Piano-type hinge structure 114, or the like, is provided on each end of the segment 112. A C-shaped stiffener member 116 (shown in FIG. 11) may be mounted on the elongated outer edges of each segment 112 and bridge the hinge joints in adjoining segments 112, 120, 122 to provide additional strength and stability for the modular bar.

The corner segment 120 (shown in FIG. 8) is preferably of an L-shaped configuration and also has hinge structure 114 at each end thereof. Cavities 120*a* and 120*b* may be formed in the upper surface for respectively retaining beverage cups and canopy support poles therein. Stiffener members 116 are mounted along the outer edges of corner segment 120.

Figure 9:
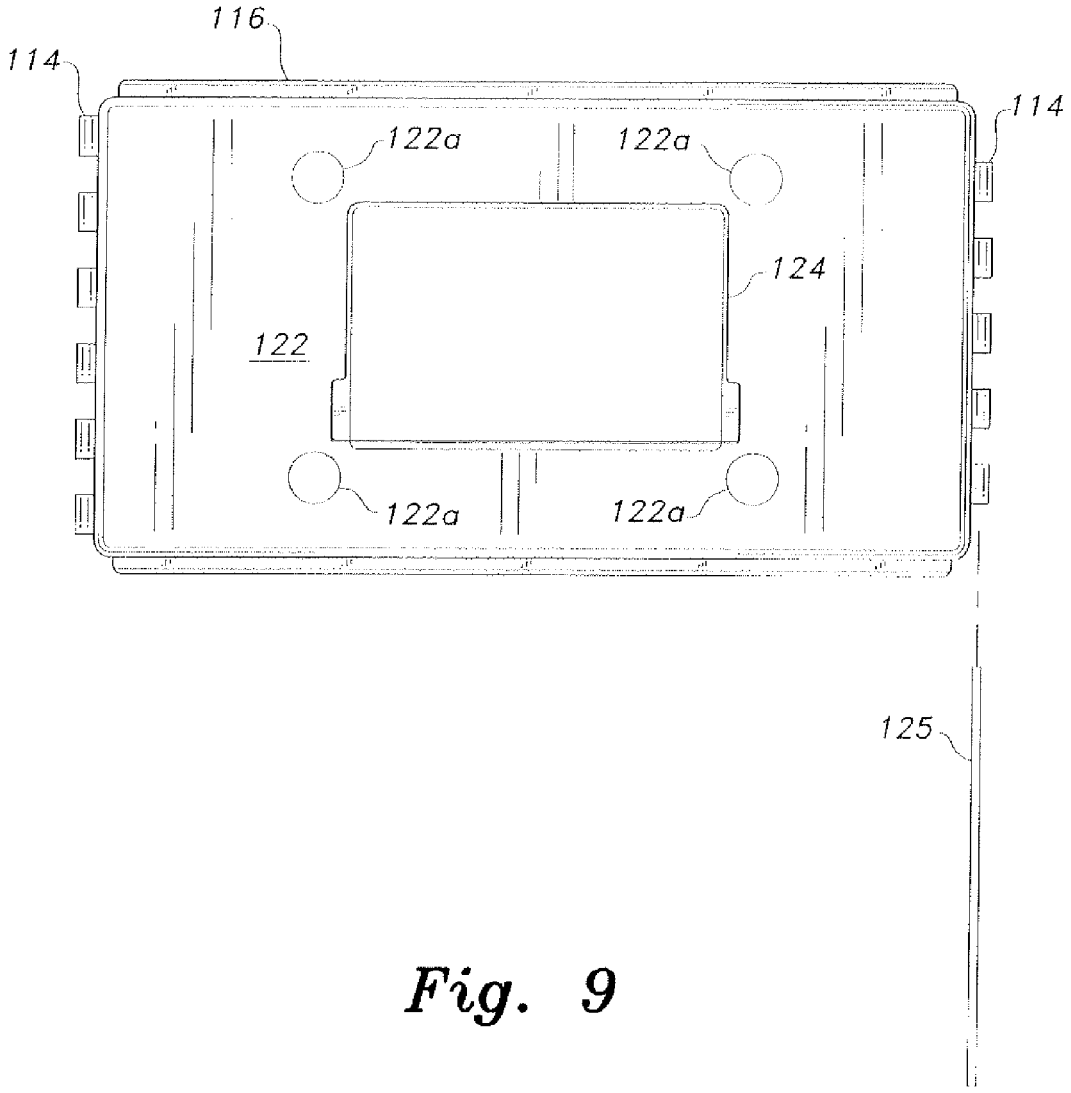
FIG. 9 is an exploded top view of a straight, modular, cooler-mount segment of the modular floating bar of FIG. 5, also showing the hinge pin.
Figure 10:
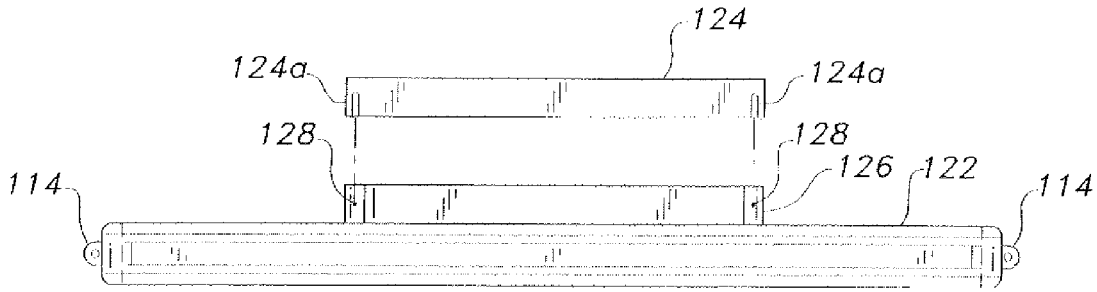
FIG. 10 is an exploded end view of the straight, modular, cooler-mount segment of FIG. 9.
Figure 11:
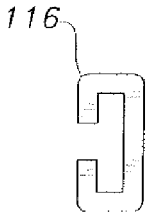
FIG. 11 is an end view of the stiffener bar utilized on the segments of the modular floating bar of FIG. 5.

FIGS. 9 and 10 illustrate a specialized straight segment 122 that provides structure to retain a conventional beverage cooler therein. A receiving member 126 is integrally formed on the top surface of the segment 122. A pair of threaded studs 128 is embedded at opposite ends of the receiving member 126. A mounting collar 124 having inverted U-shaped openings 124*a* is positioned over member 126 and attached thereto. This structure is adapted to receive and stabilize a conventional cooler therein. The cooler extends through the opening of receiving member 126 in the segment 122 and is chilled in the body of water. A connecting pin 125 is utilized to connect the hinges as is conventional in the art.

In use, the floating bar is assembled by attaching the various segments together to form the floating bar 10. The segment design allows the assembler to create a floating bar in different sizes and configurations. Although the modular floating bar 10 is shown in a U-shaped configuration in FIG. 1, it will be understood that the various straight segments may be joined in any desired length or pattern to form different configurations. The canopy 30 may be employed as desired, e.g., with opposite ends attached to parallel poles of the assembled modular floating bar, as shown in FIG. 1.

It is to be understood that the present invention is not limited to the embodiment described above, but encompasses any and all embodiments within the scope of the following claims.

I claim:

1. A modular floating bar, comprising:

a plurality of floatable, lightweight, modular segments, each of the segments having a first end, a second end, a first side, a second side and an upper surface, at least one of the segments being rectangular and at least one of the segments being L-shaped;

a respective first hinge member disposed on the first end of each of the segments;

a respective second hinge member disposed on the second end of each of the segments;

a hinge pin pivotally joining the first and second hinge members of pairs of the segments to connect the segments together;

a first edge formed on each first side of each of the segments;

a second edge formed on each second side of each of the segments; and a C-shaped stiffener member removably positioned on each of the respective first edge and second edge, each stiffener member extending between adjacent members to lock connected segments together, whereby the connected segments form an elongated floatable structure, the stiffener members preventing the hinges from pivoting while the structure is floating.

2. The floating bar according to claim 1, wherein each of the segments has a plurality of cavities formed in the upper surface, the cavities being adapted for retaining beverage containers therein.

3. The floating bar according to claim 1, wherein each of the segments has a plurality of openings formed in the upper surface thereof, the openings adapted for retaining poles for supporting a canopy.

4. The floating bar according to claim 1, further including a receiving member positioned on the surface of at least one of said segments for retaining a beverage cooler therein, and a mounting collar encompassing the receiving member.

* * * * *